US009719194B2

(12) United States Patent
Chi-Hsueh

(10) Patent No.: US 9,719,194 B2
(45) Date of Patent: Aug. 1, 2017

(54) CONDUCTIVE YARN AND APPARATUS FOR MAKING THE SAME

(71) Applicant: APOLLO SUN GLOBAL CO., LTD., San Jose, CA (US)

(72) Inventor: Richard Chi-Hsueh, San Jose, CA (US)

(73) Assignee: Apollo Sun Global Co., Ltd., San Jose, CA (US)

( * ) Notice: Subject to any disclaimer, the term of this patent is extended or adjusted under 35 U.S.C. 154(b) by 247 days.

(21) Appl. No.: 14/547,290

(22) Filed: Nov. 19, 2014

(65) Prior Publication Data

US 2015/0218734 A1 Aug. 6, 2015

Related U.S. Application Data

(60) Provisional application No. 61/965,616, filed on Feb. 3, 2014.

(51) Int. Cl.
*D02G 3/12* (2006.01)
*D02G 3/38* (2006.01)
*D02G 3/44* (2006.01)

(52) U.S. Cl.
CPC ..... *D02G 3/12* (2013.01); *D02G 3/385* (2013.01); *D02G 3/441* (2013.01)

(58) Field of Classification Search
CPC D02G 3/12; D02G 3/38; D02G 3/385; D02G 3/441
See application file for complete search history.

(56) References Cited

U.S. PATENT DOCUMENTS

| | | | | | |
|---|---|---|---|---|---|
| 100,548 | A * | 3/1870 | Morrison | D02G 3/38 | 57/210 |
| 4,070,215 | A * | 1/1978 | Gelin | B65H 49/18 | 156/161 |
| 4,590,122 | A * | 5/1986 | Levin | B04C 1/00 | 428/367 |
| 5,237,805 | A * | 8/1993 | Menegatto | D02G 3/385 | 57/16 |
| 6,127,035 | A * | 10/2000 | Carter | D02G 3/187 | 139/420 R |
| 6,600,866 | B2 * | 7/2003 | Gatica | G02B 6/02152 | 242/159 |
| 7,069,714 | B2 * | 7/2006 | De Boni | D02G 3/385 | 57/210 |
| 2005/0028512 | A1 * | 2/2005 | Boni | D02G 3/385 | 57/212 |
| 2006/0218778 | A1 * | 10/2006 | Jawahar | D02G 3/38 | 29/605 |

* cited by examiner

*Primary Examiner* — Shaun R Hurley
(74) *Attorney, Agent, or Firm* — Rosenberg, Klein & Lee

(57) ABSTRACT

A conductive yarn and an apparatus for making the same are disclosed. The conductive yarn comprises a non-conductive core thread and a fine metal thread wound around the surface of the non-conductive core thread. The fine metal thread is guided by the apparatus to wind around the surface of the non-conductive core thread in a spiral form. The apparatus comprises a base station, an axle on the base station, and a spool set on the axle for twisting the fine metal thread. The core thread passes through the center of the axle, and the axle is driven by a power to drive the spool to rotate, whereby winding the fine metal thread around the surface of the non-conductive core thread so as to form an elastic and flexible conductive yarn.

4 Claims, 6 Drawing Sheets

CONDUCTIVE YARN AND APPARATUS FOR MAKING THE SAME

CROSS REFERENCE TO RELATED APPLICATION

This application claims the benefits from U.S. Provisional Application No. 61/965,616, filed on February 3, 2014, the subject matter of which is incorporated herein by reference.

BACKGROUND OF THE INVENTION

Field of the Invention

The present invention relates a conductive yarn and an apparatus for making the same. More particularly, a fine metal thread is perfectly wound around a core thread in a spiral form via an apparatus to form a conductive yarn capable of generating heat.

Description of Related Art

The conventional heating equipment generates heat by electricity or gas. Then, the warm air is delivered to each corner of a room by each vent. Hot or warm air is light, so it moves upward and fills the upper space in the beginning of heating. After the upper space is filled with hot air, hot air falls to gradually fill the lower space. In addition, hot air moves upward so people could not feel warm immediately, which result in taking larger amount of electricity and time to raise the temperature of the air in the space to a certain degree. Moreover, the air in the space is dry, accompanying with thundering noises, due to blowing and flowing of hot air.

SUMMARY OF THE INVENTION

Therefore, the object of the present invention is to provide a conductive yarn and an apparatus for making the same. A fine metal thread is perfectly wound around a core thread in a spiral form via an apparatus to form a conductive yarn capable of generating heat.

For the above object, a conductive yarn comprises a non-conductive core thread and a fine metal thread wound around the surface of the non-conductive core thread. The fine metal thread is guided by an apparatus to wind around the surface of the non-conductive core thread in a spiral form so as to form an elastic and flexible conductive yarn.

According to an embodiment of the present invention, the conductive yarn is used for manufacturing a fabric and the fabric is made of a plurality of conductive metal wires in a warp direction, which are limited to two sides of the fabric, a plurality of non-conductive threads in the warp direction, which are limited to the middle part of the fabric, and a plurality of conductive yarns in a weft direction, whereby interlacing the fine metal threads of the conductive yarn with the conductive metal wires of the warp direction so as to form a well-conductive fabric.

According to an embodiment of the present invention, the diameter of the conductive metal wire ranges from 0.05 to 0.12 m/m.

According to an embodiment of the present invention, the diameter of the fine metal thread ranges from 0.02 to 0.12 m/m.

According to an embodiment of the present invention, the fine metal thread wound around the non-conductive core thread is wound at 70 to 125 coils per centimeter of the non-conductive core thread.

According to an embodiment of the present invention, a power supply unit provides 0 to 24 Volts direct current when the fabric is conducted.

For the above object, an apparatus for making a conductive yarn comprises a base station, an axle seat, an axle, a base, a turning wheel, a spool, a first power source, a spindle, and a second power source. The axle seat is set on the base station, and the axle having a hole along its center is embedded on the axle seat. The base is mounted on the axle, and the turning wheel is set underneath the base. The spool is twisted around by a fine metal thread and is embedded on the base. The first power source is set on the base station for driving a driving wheel and the driving wheel is engaged with the turning wheel. The spindle is twisted around by a core thread and is set under the base station. The core thread is through the hole of the axle and then the fine metal thread is wound around the core thread to form a conductive yarn. The second power source is set above the base station for driving a take-up spool. Therefore, by switching on the power sources and the take-up spool, the axle is rotated by power to drive the spool to rotate; meanwhile the take-up spool is rotated for pulling the core thread so as to parabolically wind the fine metal thread around the core thread in a spiral form according to the rotation speed of the spool.

According to an embodiment of the present invention, the apparatus further comprises a controller for controlling the power switch and the rotation speed.

According to an embodiment of the present invention, the apparatus further comprises a plurality of guide pulleys, set on the base station for guiding the core thread through the hole of the axle and guiding the conductive yarn to wind around the take-up spool.

According to an embodiment of the present invention, the apparatus further comprises a limiting column set on the base for positioning the spool.

According to an embodiment of the present invention, the apparatus further comprises a flange set on the top of the axle for positioning the spool while rotation.

According to the above description and embodiments, the conductive yarn and the apparatus for making the same of the present invention have the advantages as following:

1. The apparatus for making a conductive yarn of the present invention exerts an upward pull on the non-conductive core thread for winding the fine metal thread around the non-conductive core thread to form the conductive yarn of the present invention. The conductive yarn of the present is not easy to be broken and is soft and flexible.

2. When the fine metal thread wound around the core thread in the spiral form is conducted with electricity to generate heat, the conductive yarn of the present invention has well elasticity for thermal expansion and contraction.

3. The conductive yarn of the present invention is blended with other yarn and woven into the fabrics with different uses and the fabrics could be dyed, printed, washed, and cutting. The fabrics could be made into mattress, curtains, textile wall, oversleeves, knee braces, waist supports, foot pads, seat cushions, and carpets etc for generating heat while being conducted with electricity and replacing various heating equipment in winter.

4. Compared with conventional heaters, the power consumption of the conductive yarn of the present invention is reduced by more than 45%.

DETAILED DESCRIPTION OF THE PREFERRED EMBODIMENT

Figure 2:
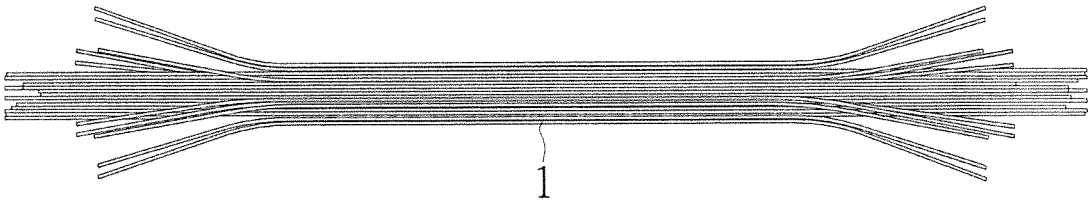
FIG. 2 is a schematic view of a core thread according to the embodiment of the present invention.
Figure 3:
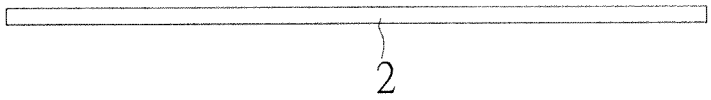
FIG. 3 is a schematic view of a fine metal thread according to the embodiment of the present invention.
Figure 4:
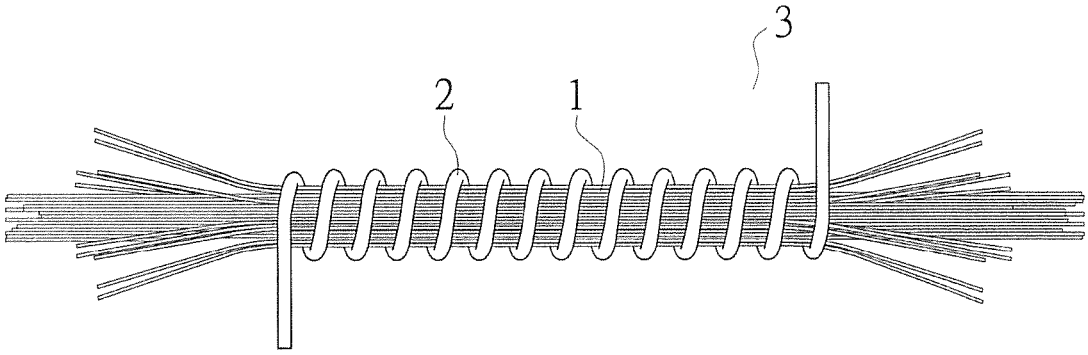
FIG. 4 is a schematic view of a conductive yarn according to the embodiment of the present invention.
Figure 5:
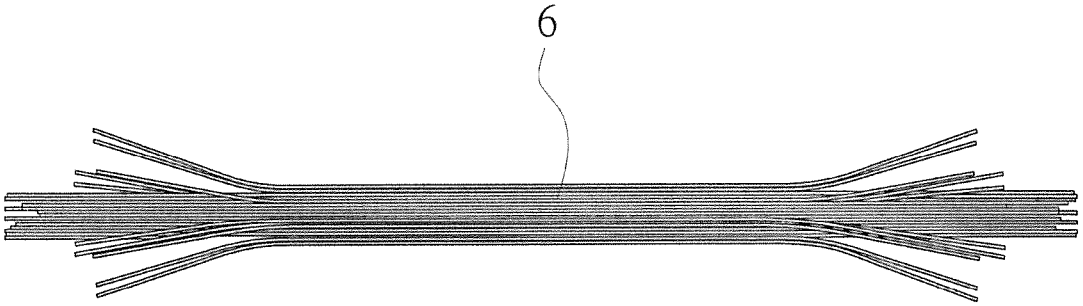
FIG. 5 is a schematic view of a metal conductive wire according to the embodiment of the present invention.
Figure 6:
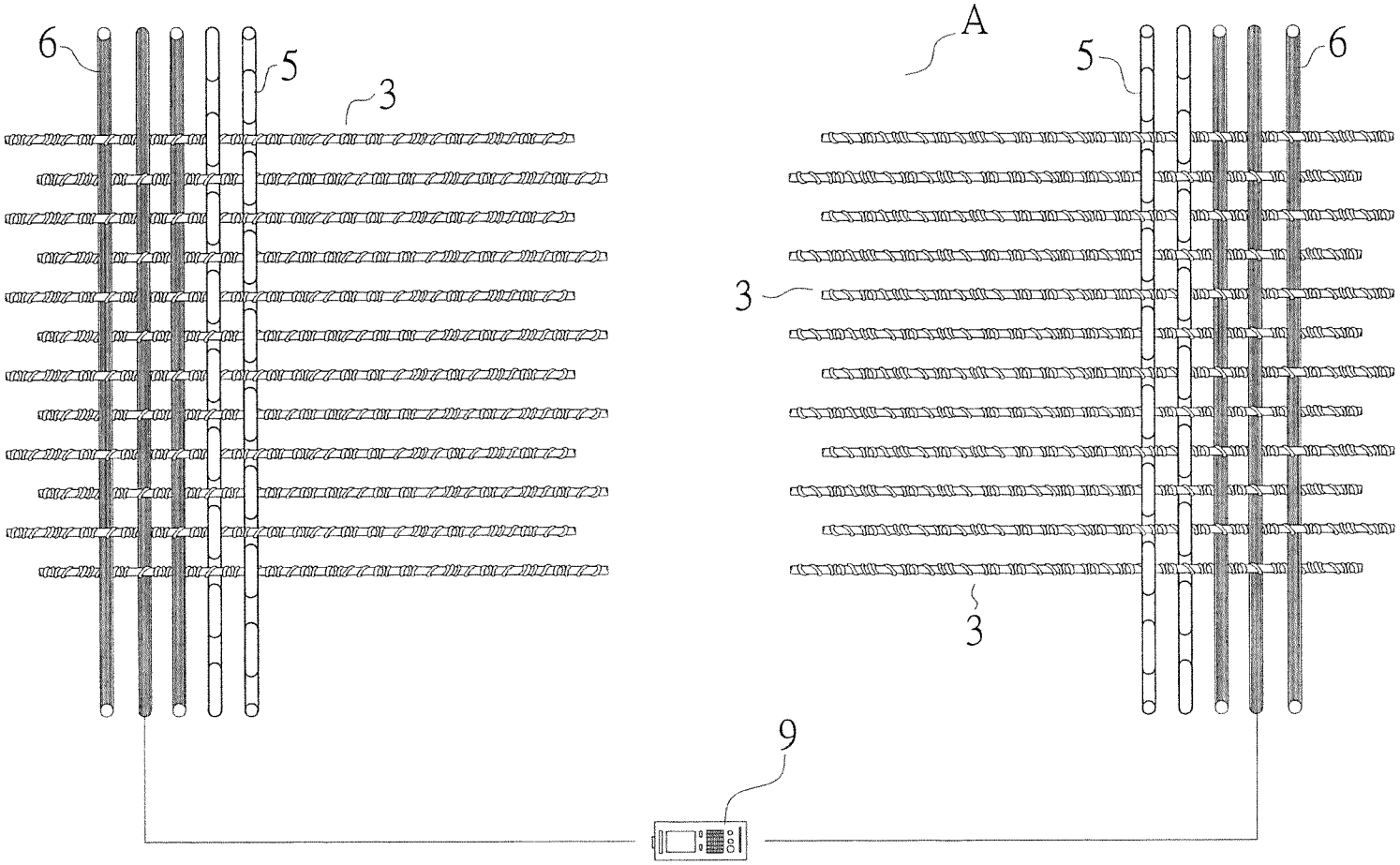
FIG. 6 is a schematic view of a cloth according to the embodiment of the present invention.

FIG. 2 to FIG. 4 show schematic views of a core thread, a fine metal thread, and a conductive yarn respectively according to the embodiment of the present invention. A conductive yarn comprises a non-conductive core thread 1 and a fine metal thread 2 wound around the surface of the core thread 1. The non-conductive core thread 1 is made of a plurality of fibers. The fine metal thread 2 is conductive and made of gold, silver, copper, tungsten, and molybdenum microfilament etc, for example. The diameter of the fine metal thread 2 ranges from 0.02 to 0.12 m/m. The fine metal thread 2 is guided by an apparatus to wind around the surface of the core thread 1 in a spiral form so as to form an elastic and flexible conductive yarn 3.

Figure 1:
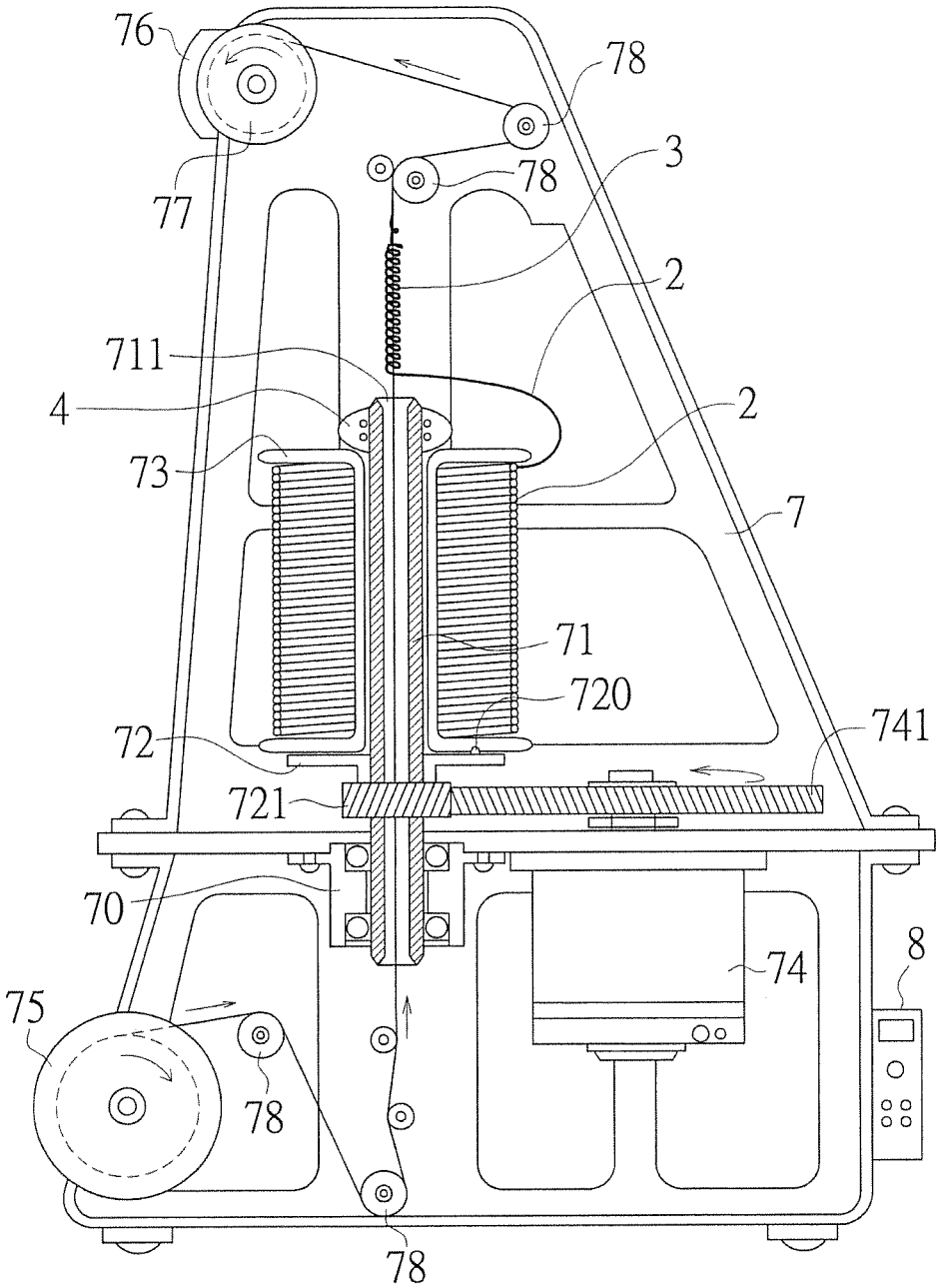
FIG. 1 is a cross-sectional view of an apparatus for making a conductive yarn according to the embodiment of the present invention.

The apparatus for making the conductive yarn according to the embodiment of the present invention is shown in FIG. 1. The apparatus comprises a base station 7, an axle seat 70, an axle 71, a base 72, a turning wheel 721, a spool 73, a first power source 74, a spindle 75, and a second power source 76.

The axle seat 70 is set on the base station 7, and the axle 71 has a hole 711 along its center and is embedded on the axle seat 70. The base 72 is mounted on the axle 71, and the turning wheel 721 is set underneath the base 72. The spool 73 is twisted around by the fine metal thread 2 and is embedded on the base 72. A flange 4 is set on the axle 71 for positioning the spool 73. The first power source 74 is set on the base station 7 for driving a driving wheel 741 and the driving wheel 741 is engaged with the turning wheel 721. The spindle 75 is twisted around by the core thread 1 and is set under the base station 7. The core thread 1 is through the hole 711 of the axle 71 and then the fine metal thread 2 is wound around the surface of the core thread 1 to form a conductive yarn. The second power source 76 is set above the base station 7 for driving a take-up spool 77 for twisting the conductive yarn.

Please refer to FIG. 1. When the apparatus is actually used to making the conductive yarn, the non-conductive thread 1 is wound around the spindle 75 and is guided by several guide pulleys 78 to pass through the hole 711 of the axle 71 and to wind around the take-up spool 77. Next, the spool 73 twisted around by the fine metal thread 2 is embedded on the base 72, and a limiting column 720 is set on the base 72 for positioning the spool 73. The flange 4 set on the axle 71 is used to position the spool 73. In the beginning, the fine metal thread 2 is wound around the core thread 1. A controller 8 is used to control the first power source 74, the second power sources 76, and the take-up spool 77 and to set the rotation speed ranging from 0 to 4800 rpm. The axle 71 is driven by the first power source 74 to drive the spool 73 to rotate, meanwhile the second power source 76 drives the take-up spool 77 to rotate for pulling the core thread 1, thereby parabolically winding the fine metal thread 2 around the surface of the core thread 1 in a spiral form according to the rotation speed of the apparatus. When the non-conductive core thread is moved up per centimeter, the fine metal is wound around the surface of the non-conductive core thread at 70 to 125 coils so as to form the conductive yarn 3 capable of generating heat. Finally, the conductive yarn 3 is wound around the take-up spool 77.

Next, please refer FIG. 2 to FIG. 6. While manufacturing plain or blended fabric, the conductive yarn 3 is utilized to be weft yarn and the warp yarn is a regular non-conductive yarn 5 with different colors. The weft yarn and the warp yarn are interlaced with each other to manufacture various types of clothes and carpets with conductivity and well flexibility, and the clothes and carpets could be dyed, printed, or figured damask. In addition, the conductive yarn 3 could be made into fiber with different diameter for a wide range of applications. For example, a fine conductive yarn 3 could be made into regular fabric, bed sheets, coverlets, curtains, or various kinds of conductive clothes capable of generating heat for keep warming. Or, a thicker conductive yarn 3 could be woven with general thicker yarn to produce various kinds of electro-heating blankets, carpets, or mat for melting snow.

The principle and function of the conductive yarn and the apparatus for making the same are described below.

When producing or weaving various fabrics, a plurality of conductive metal wires 6 limited to two sides of the fabric in 0.5 to 0.6 centimeters are disposed in the warp direction of fabric A to be conductive yarns, and the general non-conductive yarns 5 are limited in the middle part of the fabric A in the warp direction. The conductive metal wires 6 are fine copper wires or sliver wires with diameter ranging from 0.05 to 0.12 m/m, and the non-conductive yarns 5 could be different color or made of different materials. The conductive yarns 3 that include the core threads 1 made of a plurality of fibers and the fine metal threads 2 wound around the core threads 1 are disposed in the weft direction. The fine metal threads 2 wound around the surface of the core threads 1 in the weft direction are interlaced and woven with the conductive metal wires 6 (fine copper wires or silver wires) on two sides of the fabric in the warp direction so as to form a conductive path. A power supply unit 9 provides alternating current (AC) or direct current (DC) power, 0V to 24V, to the conductive metal wires 6 disposed on the two sides of the fabric A for generating heat. Moreover, the voltage (V), current (A), temperate (T), and time could be fine tuned by a computer, so the fabric could generate heat to provide desired temperature ranging from 0° C. to 65° C. Therefore, a required uniform temperature is generated among yarns of the fabric A. Therefore, the fabric A saves power and there is no risk of electric shock and electromagnetic wave.

In use, when a fixed or moveable carpet is placed on the ground indoors for providing warmth, each small unit in one plane within the same unit area generates uniform heat. Because the hot air rises naturally, there is not necessary to deliver hot air by blowers. Therefore, the heat from electric carpets produced by fabric containing conductive yarns of the present invention naturally rises from the floor or the bottom of the carpet to each corner of the space until the temperature is raised to a uniform value. There is no dryness, noises or other uncomfortable feelings caused by hot air.

Moreover, the fabric containing the conductive yarn of the present invention could be cut along the weft direction. The cutting length and size are determined according to the requirements. The conductive metal wires 6 on the two sides of the cut fabric are connected in parallel or in series and conducted with electricity so as to form another piece of fabric capable of generating heat. The fabric capable of generating heat could be utilized to make the article of daily use for resisting cold, such as bed sheets, mattress, coverlets, cushion, curtains, and wall covering, or be woven into different size of blanket, carpet, or mat for melting snow which is laid on the floor without construction and is very safety and convenient to provide heat indoor. The foregoing fabric could be also made into tent or diving suit.

However, the foregoing embodiments and drawings does not limits the product structures or uses of the present invention, it will be obvious to those skilled in the art that various modifications may be made without departing from the sprit and the scope of the present invention.

What is claimed is:

1. An apparatus for making a conductive yarn, comprising:

a base station, the base station defining a winding compartment;

an axle seat set on the base station;

an axle having a hole along its center, wherein the axle is coupled to the axle seat and extends into the winding compartment;

a base mounted on the axle;

a turning wheel set underneath the base and coupled to an intermediate portion of the axle to be disposed within the winding compartment;

a spool for a fine metal thread, the spool being supported on the base within the winding compartment;

a first power source set on the base station for driving a driving wheel disposed within the winding compartment, the driving wheel being gear-engaged to the turning wheel;

a spindle for providing a core thread set under the base station, wherein the core thread is advanced through the hole of the axle, and the fine metal thread is wound around the surface of the core thread within the winding compartment to form a conductive yarn; and a second power source set on the base station for driving a take-up spool for twisting the conductive yarn.

2. The apparatus according to claim 1, further comprising:

a controller for controlling the first and second power sources and a rotation speed thereof.

3. The apparatus according to claim 2, further comprising:

a plurality of guide pulleys, set on the base station for guiding the core thread through the hole of the axle and guiding the conductive yarn to wind around the take-up spool.

4. The apparatus according to claim 3, further comprising:

a limiting column, set on the base for positioning the spool.

* * * * *